US007240606B2

(12) United States Patent
Andersen, Jr.

(10) Patent No.: US 7,240,606 B2
(45) Date of Patent: Jul. 10, 2007

(54) CRIMPED PISTON TO ROD JOINT

(75) Inventor: Robert E. Andersen, Jr., Barrington, IL (US)

(73) Assignee: Parker-Hannifin Corporation, Cleveland, OH (US)

( * ) Notice: Subject to any disclaimer, the term of this patent is extended or adjusted under 35 U.S.C. 154(b) by 26 days.

(21) Appl. No.: 11/182,082

(22) Filed: Jul. 15, 2005

(65) Prior Publication Data

US 2006/0013715 A1 Jan. 19, 2006

Related U.S. Application Data

(60) Provisional application No. 60/588,132, filed on Jul. 15, 2004.

(51) Int. Cl.
*F04B 53/00* (2006.01)
*F04B 39/00* (2006.01)

(52) U.S. Cl. ..... 92/128; 92/169.1

(58) Field of Classification Search ..... 92/128, 92/169.1, 172, 255
See application file for complete search history.

(56) References Cited

U.S. PATENT DOCUMENTS

| | | | | |
|---|---|---|---|---|
| 3,263,311 | A | 8/1966 | Riedhammer et al. | |
| 3,457,842 | A * | 7/1969 | Tennis | 92/256 |
| 3,808,956 | A | 5/1974 | Knapp | |
| 3,951,048 | A * | 4/1976 | Bloom et al. | 92/258 |
| 4,317,409 | A * | 3/1982 | Bottoms | 92/244 |
| 4,405,251 | A * | 9/1983 | Kolchinsky et al. | 403/9 |
| 4,630,958 | A * | 12/1986 | McCallister | 92/128 |
| 4,757,751 | A * | 7/1988 | Munoz | 92/165 R |
| 4,926,745 | A * | 5/1990 | Cioletti | 92/256 |
| 5,163,224 | A | 11/1992 | Wells et al. | |
| 5,218,763 | A | 6/1993 | Marker et al. | |
| 5,388,677 | A | 2/1995 | Rösch | |
| 5,595,269 | A * | 1/1997 | Beck | 188/282.6 |
| 5,839,353 | A | 11/1998 | Mecham | |
| 6,289,786 | B1 | 9/2001 | Plantan et al. | |
| 6,363,833 | B1 | 4/2002 | Stoll | |
| 6,460,571 | B1 | 10/2002 | Rajabi et al. | |

FOREIGN PATENT DOCUMENTS

| | | |
|---|---|---|
| DE | 40 25 702 | 3/1991 |
| DE | 4443472 C1 * | 3/1996 |
| DE | 100 05 236 | 9/2001 |
| FR | 2 465 109 | 3/1981 |

OTHER PUBLICATIONS

International Search Report and Written Opinion for International Application No. PCT/US2005/025333 dated Nov. 17, 2005.

* cited by examiner

*Primary Examiner*—Igor Kershteyn
(74) *Attorney, Agent, or Firm*—Renner, Otto, Boisselle & Sklar, LLP

(57) ABSTRACT

A method for assembling a piston on a rod, and resultant piston and rod assembly, uses one or more lock rings that are mechanically deformed radially inwardly into respective locking grooves in the rod, thereby axially locking the lock ring to the rod. The lock ring can function as an axial stop for the piston or can be formed integrally with the piston. The method of assembly minimize unwanted strains and stresses in the piston and rod, while providing a secure and durable joint between the piston and rod.

20 Claims, 2 Drawing Sheets

CRIMPED PISTON TO ROD JOINT

RELATED APPLICATIONS

This application claims the benefit of U.S. Provisional Application No. 60/588,132 filed Jul. 15, 2004, which is hereby incorporated herein by reference in its entirety.

FIELD OF THE INVENTION

The present invention relates generally to piston and rod assemblies used in hydraulic and pneumatic cylinders, accumulators and the like.

BACKGROUND OF THE INVENTION

As is well known in the art, cylinder products use piston and rod components that are attached to each other by various methods. One such method is peening. Peening requires forces axial to the rod in order to deform material from the rod to interfere with a chamfered area of the back of the piston. During the attachment process these forces have to be countered. The force can be frictionally countered on the outer diameter (OD) of the rod, but this may result in marring of the rod surface. If the rod surface is marred, the operation of the piston/rod assembly can be negatively affected. Alternatively, the force can be opposed at the opposite end of the rod, which can result in column loading of the rod and the potential for bending, particularly when subjected to forces necessary to cause adequate deformation for high strength applications.

Another prior art assembly method for attaching the piston to the rod uses a threaded joint. Assembly is effected by simple rotation of the piston and rod relative to one another. During assembly of the piston on the rod, the unthreaded portion of the rod typically acts as a pilot for centering the piston on the rod. The piston and rod may be torqued relative to one another to provide an assembled joint of a desired strength, and a set screw or pin may be installed tangentially to the threaded area of the joint to lock the piston and rod against relative rotation. In order to provide a pressure tight seal between the piston and the rod, and further to add strength to the assembled joint to prevent the parts from separating during operation, an adhesive heretofore has been used at the threaded joint. This, however, usually requires the mating surfaces of the piston and rod to be clean to obtain proper adhesion between the piston and rod. The cleaning process is costly, primarily because of the time needed to clean the parts. In addition, further time is needed to allow the adhesive to properly cure before the assembly can be further assembled with other components of a pneumatic or hydraulic cylinder.

SUMMARY OF THE INVENTION

The present invention provides a method for assembling a piston on a rod that overcomes one or more drawbacks associated with the prior art methods of assembly. The method and resultant joint uses one or more lock rings that are mechanically deformed into respective locking grooves in the rod, thereby axially locking the lock ring to the rod. The lock ring can function as an axial stop for the piston or can be formed integrally with the piston. This method of assembly minimizes unwanted strains and stresses in the piston and rod, while also providing a secure and durable joint between the piston and rod.

Accordingly, the invention provides a method for assembling a piston on a rod that comprises telescopically positioning a lock ring on the rod at a radially outwardly opening locking groove, mechanically deformed the lock ring into the locking groove axially to lock the lock ring to the rod, and using the lock ring to prevent the piston from moving axially on the rod in at least one direction.

The invention also provides a piston and rod assembly for use in hydraulic or pneumatic cylinders, comprising a piston having opposite axial ends, a rod having at least one radially outwardly opening locking groove, and at least one annular lock ring telescoped onto the rod and mechanically deformed into the locking groove axially to lock the lock ring to the rod, the lock ring being located adjacent an axial end of the piston to prevent the piston from moving axially on the rod in at least one direction.

The lock ring may be unitary with the piston, with the ring extending axially from the adjacent axial end of the piston. Alternatively, the lock ring and piston may be formed as separate components, with an axial end of the piston abutting the lock ring to prevent axial movement of the piston in the direction of the lock ring. The piston may be axially trapped between a pair of lock rings that have been mechanically deformed into respective grooves in the rod, or between a lock ring and a radial shoulder on the rod.

As is preferred, the locking groove extends annularly around the rod and has at least one or both side walls provided with a rounded and/or angled portion. The piston may be sealed to the rod by suitable means, such as by an annular seal retained in a sealing groove axially spaced from the locking groove, or by use of an adhesive.

The lock ring preferably is mechanically deformed by crimping. The lock ring may be mechanically deformed into the locking groove sufficiently to provide a radial as well as an axial interference that prevents rotation of the piston relative to the rod while also preventing axial movement of the piston relative to the rod.

Further features of the invention will become apparent from the following detailed description when considered in conjunction with the drawings.

BRIEF DESCRIPTION OF THE DRAWINGS

In the annexed drawings

DETAILED DESCRIPTION

Figure 1:
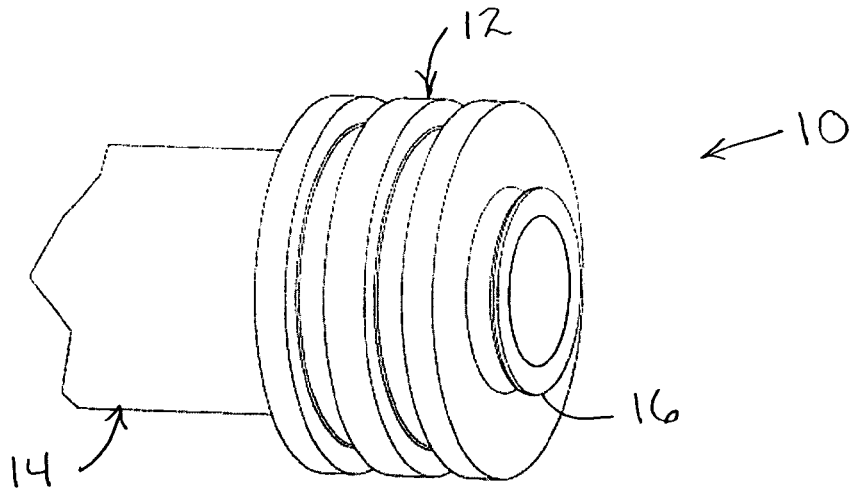
FIG. 1 is a perspective view of an exemplary piston and rod assembly according to the invention.

Referring now to the drawings in detail and initially to FIG. 1, an exemplary piston and rod assembly constructed in accordance with the invention is indicated generally at 10.

Piston and rod assemblies according to the invention may be used hydraulic and pneumatic cylinders, and other products as well.

The piston and rod assembly 10 comprises a piston 12 which is permanently attached to a rod 14 by a crimped lock ring 16. The lock ring 16 can be formed integrally (as one piece) with the piston 12 as shown in FIGS. 1 and 3, or as a separate piece as described below in conjunction with the piston and cylinder assemblies shown in FIGS. 7 and 8.

Figure 2:
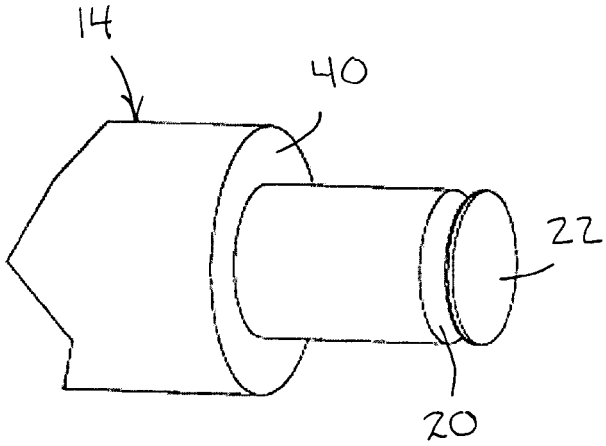
FIG. 2 is a perspective view of the rod of FIG. 1 prior to assembly with the piston.
Figure 3:
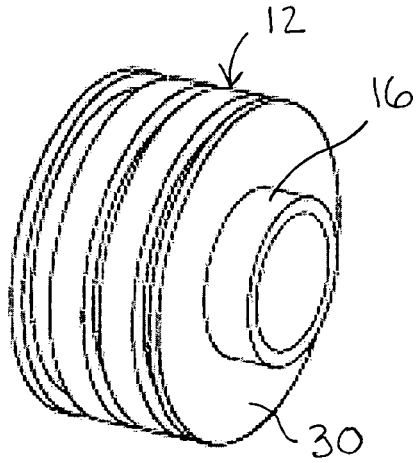
FIG. 3 is a perspective view of the piston with an integral lock ring prior to crimping of the lock ring into a groove on the rod.

In FIGS. 2 and 3, the rod 14 and piston 12 are shown prior to assembly. As seen in FIG. 2, the rod has a radially outwardly opening locking groove 20 disposed inwardly of the axial end face 22 of the rod. The shape of the groove 20 can vary. For example, the shape may be fully radial, or include a flattened area, or have one side shaped and flattened to a squared shoulder. More particularly, the groove may have a generally flat bottom and sidewalls that extend from the flat bottom to the outer surface of the rod. In the illustrated embodiment, the sidewalls are both rounded or curved. A smooth rounded or curved shape may contribute to a permanent and fluid-tight seal when the lock ring 16 is mechanically deformed into the groove as further discussed below.

As seen in FIG. 3, the lock ring 16 is formed as an integral axial extension of the functional portion of the piston 12. More particularly, the ring 16 extends from an axial end face 30 of the piston and coaxially with the piston. If desired, the ring 16 may be incorporated into (or formed by) other functional elements of the piston and rod assembly, such as cushion sleeves/spears of the assembly that are located axially beyond the functional portions of the piston. Although the ring that is mechanically deformed into the locking groove is annularly continuous, for some applications it may be desirable for the ring to be composed of a plurality of circumferentially disposed segments that are mechanically permanently deformed into the locking groove need not be circumferentially continuous. However, the ring or segments thereof preferably are squeezed or swaged into the locking groove until it takes the shape of the locking groove. This preferred form of crimping is in contrast to prior art assembly techniques involving the bending of tabs.

Figure 4:
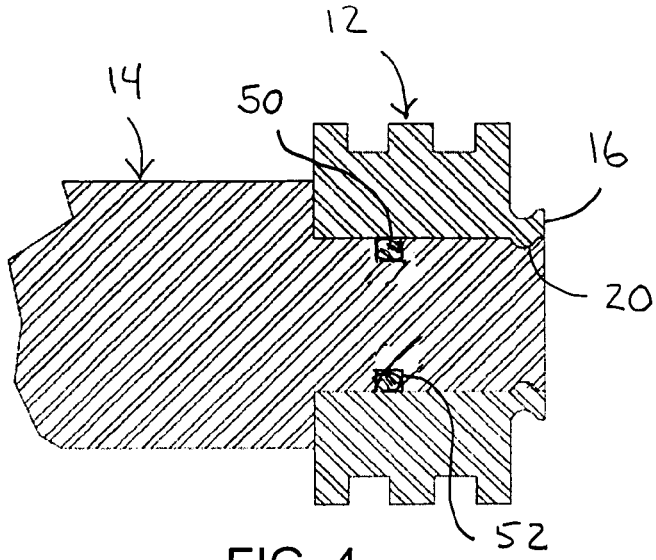
FIG. 4 is a cross-sectional view of the piston and rod assembly, showing the joint formed between the piston and rod.

The inner diameter surface of the lock ring 16 forms a continuation of the inner diameter surface of the piston 12, and both inner diameter surfaces are sized to be telescoped onto the rod with a close fit as shown in FIG. 1. In the illustrated embodiment and as best seen in FIG. 4, the piston is telescoped onto the rod until it abuts a radial shoulder 40 on the rod. During assembly, the radial shoulder may function as a positioning stop for properly aligning the lock ring with the groove 20 into which the ring is permanently deformed. After assembly, the shoulder may coact with the ring/groove interlock to hold the piston in fixed position on the rod.

After the piston 12 with the lock ring 16 has been assembled onto the rod and the lock ring aligned with the groove 20, the lock ring is permanently mechanically deformed radially inwardly into the groove as shown in FIG. 4, thereby to create a mechanical interference between the ring and the rod. This will prevent the piston from moving axially or becoming detached from the rod. In addition, the mechanical interference is effected in a manner that minimizes stress concentrations in the functional portions of the mating components. In particular, the stress concentration caused by deformation of the lock ring is isolated from the piston proper. Overall, this arrangement provides better fatigue properties than prior art designs, as well as better strength and ease of assembly.

The lock ring 16 should be small enough in radial dimension to allow for adequate deformation of the lock ring into the groove 20 and yet large enough to provide adequate resistance to forces imposed on the piston and rod assembly when in use. Preferably, the lock ring is sufficiently deformed to fill the groove. The lock ring also may be mechanically deformed into the locking groove sufficiently to provide a radial as well as an axial interference that prevents rotation of the piston relative to the rod while also preventing axial movement of the piston relative to the rod.

As above mentioned, a permanent and fluid-tight seal may be formed when the lock ring 16 is mechanically deformed into the groove 20. This seal may be sufficient for various applications. For higher pressure applications, for example, additional sealing may be desired. To this end, the piston alternatively or additionally may be sealed to the rod by other means, such as by an annular seal 50 retained in a sealing groove 52 axially spaced from the locking groove 20, or by use of a suitable adhesive which may also contribute to the permanent mechanical connection between the piston and rod. An anaerobic adhesive may be used as it will set up in the absence of oxygen.

During assembly, the rod and the piston with the ring may relatively positioned in any suitable manner prior to crimping the ring to the rod. For instance, the rod and piston may be positioned in a die provided with appropriate physical stops for locating the parts in proper position relative to one another during crimping.

Figure 5:
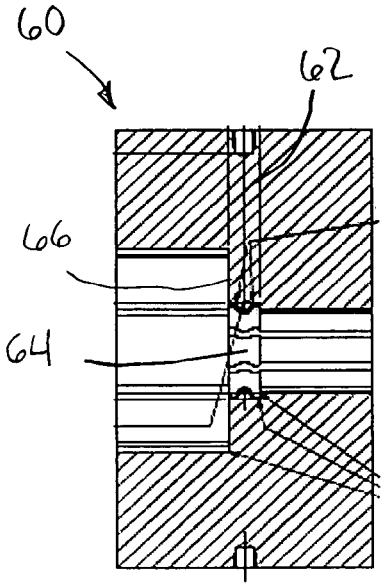
FIG. 5 is a cross-sectional view of a crimping die used to crimp the lock ring into the groove on the rod.
Figure 6:
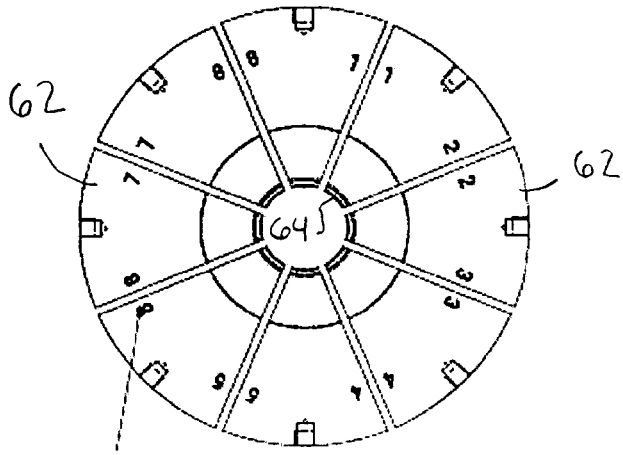
FIG. 6 is an end view of the crimping die of FIG. 5.

An exemplary crimping die is shown in FIGS. 5 and 6. The crimping die 60 includes a plurality of radially movable segments 62 that each have a radially inner operating surface 64 with a geometry intended to deform a respective portion of the lock ring into the groove in the rod. The axially inner surfaces 66 of the die segments function as a locating stop for an end face of the piston when located in a larger diameter chamber of the die 60. The rod will also be properly located in the die, with the groove therein radially aligned with the die segments 62, by engagement of the shoulder 40 with the end face of the piston.

While crimping is one preferred means for deforming the lock ring into the groove, it should be appreciated that other mechanical forming methods could alternatively be used. These other methods include, but are not limited to, cold-forming, magnaforming and staking, and generally any other method which achieves a permanent deforming of the lock ring into the grooves.

For some applications, the mechanical interference between the crimped ring and groove in the rod alone may by sufficient for securing the piston to the rod. Hence, the rod need not necessarily be provided with the shoulder 40. The piston may also be provided with two lock rings integrally joined therewith, one projecting from each axial end face of the piston. The rod would then be provided with corresponding grooves into which the lock rings are mechanically permanently deformed to secure the piston to the rod.

Figure 7:
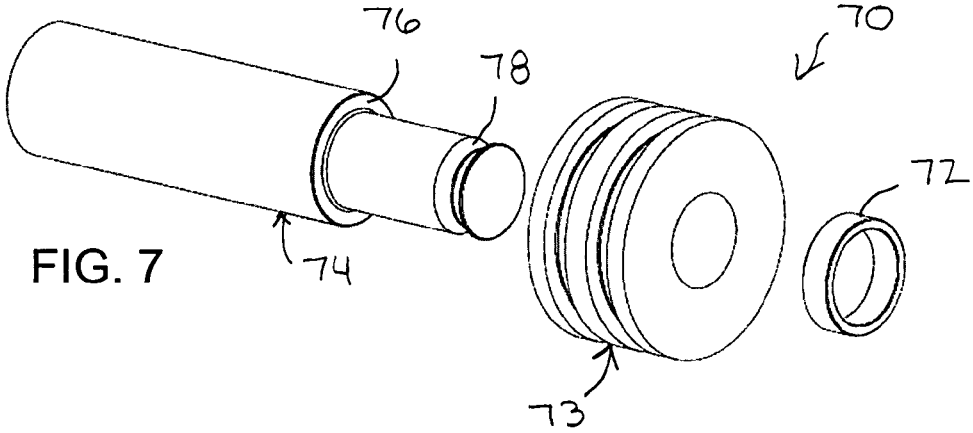
FIG. 7 is an exploded perspective view of another piston and rod assembly according to the invention.

FIG. 7 shows another piston and rod assembly 70 according to the invention. This assembly 70 is identical to that shown in FIGS. 1–3, except the lock ring 72 is formed as a separate piece. After the piston 73 is telescoped onto the rod 74 and butted against the radial shoulder 76 on the rod, the lock ring 72 is slipped onto the rod and aligned with the groove 78 in the rod. The lock ring is then mechanically deformed into the groove as above described to lock the piston to the rod.

Figure 8:
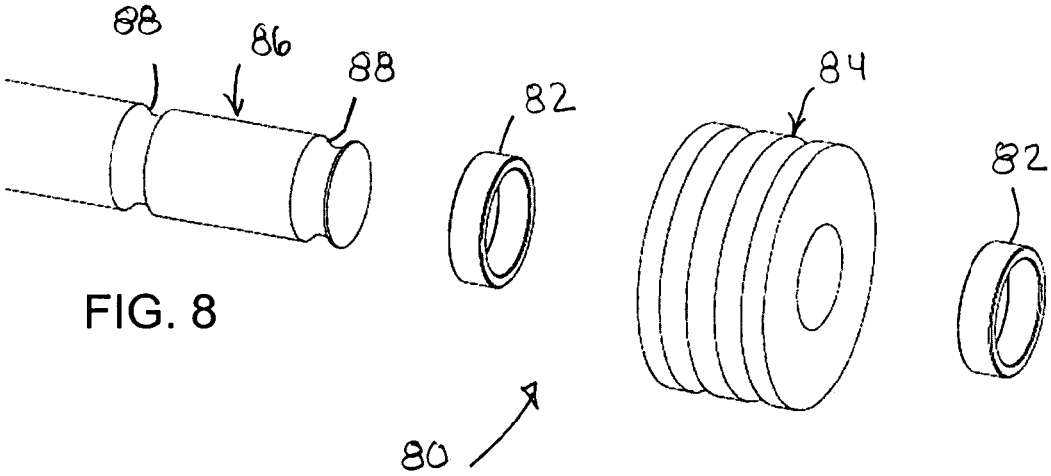
FIG. 8 is an exploded perspective view of yet another piston and rod assembly according to the invention.

FIG. 8 shows yet another piston and rod assembly 80 according to the invention. In the assembly 80, two lock rings 82 are used to secure the piston 84 to the rod 86. The rod includes two annular locking grooves 88 axially spaced apart such that the piston will be axially restrained against movement relative to the rod by the lock rings after the lock rings have been mechanically deformed into the grooves as above described. A crimping die can be suitably configured with locating means for properly positioning the rod, rings and piston prior to crimping of the rings in the locking grooves.

In view of the foregoing, it can now be appreciated that features and advantages of afforded by the invention include, but are not limited to, a permanent mechanical joint, reduction of required machining (no threads common to connections of this type), and reduction in the time and labor content required for manufacture of this assembly. Due to reduced machining and the mechanical interference nature of the connection, machining time may be reduced. The need for special cleaning (although desired when an anaerobic or other adhesive is used as above mentioned) may be eliminated. A mechanical joint formed in accordance with the invention may also provide superior fatigue resistance relative to a welded joint.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A piston and rod assembly for use in hydraulic or pneumatic cylinders, comprising a piston having opposite axial ends, a rod having at least one radially outwardly opening locking groove, and at least one annular lock ring telescoped onto the rod and permanently mechanically deformed into the locking groove axially to lock the lock ring to the rod, the lock ring being located adjacent an axial end of the piston to prevent the piston from moving axially on the rod in at least one direction.

2. A piston and rod assembly according to claim 1, wherein the lock ring is unitary with the piston and extends axially from the adjacent axial end of the piston.

3. A piston and rod assembly according to claim 1, wherein the lock ring and piston are formed as separate components, and an axial end of the piston abuts the lock ring to prevent axial movement of the piston in the direction of the lock ring.

4. A piston and rod assembly according to claim 1, wherein the locking groove extends annularly around the rod.

5. A piston and rod assembly according to claim 1, wherein the locking groove has at least one side wall provided with a rounded and/or angled portion.

6. A piston and rod assembly according to claim 5, wherein the locking groove has opposed side walls that are rounded.

7. A piston and rod assembly according to claim 1, wherein the piston is sealed to the rod.

8. A piston and rod assembly according to claim 7, wherein the piston is sealed to the rod by an annular seal retained in a sealing groove axially spaced from the locking groove.

9. A piston and rod assembly according to claim 7, wherein the piston is sealed to the rod by an adhesive.

10. A piston and rod assembly according to claim 1, wherein the rod has a radially outwardly extending shoulder axially spaced from the locking groove, and the piston is axially trapped between the shoulder and the lock ring.

11. A piston and rod assembly according to claim 1, wherein the lock ring is permanently mechanically deformed by crimping.

12. A piston and rod assembly according to claim 1, wherein the lock ring is permanently mechanically deformed into the locking groove to provide a radial as well as an axial interference which prevent rotation of the piston relative to the rod.

13. A piston and rod assembly according to claim 1, wherein the at least one locking groove includes first and second locking grooves axially spaced apart along the rod, and the at least one locking ring includes first and second locking rings telescoped onto the rod and permanently mechanically deformed into the first and second locking grooves axially to lock the first and second lock rings to the rod, respectively, and the first and second lock rings are located adjacent respective axial ends of the piston to prevent the piston from moving axially on the rod.

14. A method for assembling a piston on a rod, comprising:

telescopically positioning a lock ring on the rod at a radially outwardly opening locking groove;

permanently mechanically deforming the lock ring into the locking groove axially to lock the lock ring to the rod; and using the lock ring to prevent the piston from moving axially on the rod in at least one direction.

15. A method according to claim 14, wherein the lock ring is unitary with the piston and extends axially from the adjacent axial end of the piston.

16. A method according to claim 14, wherein the lock ring and piston are formed as separate components, and an axial end of the piston abuts the lock ring to prevent axial movement of the piston in the direction of the lock ring.

17. A method according to claim 14, wherein the locking groove extends annularly around the rod.

18. A method according to claim 14, wherein the locking groove has at least one side wall provided with a rounded and/or angled portion.

19. A method according to claim 14, comprising the step of sealing the piston to the rod by an annular seal and/or an adhesive.

20. A method according to claim 14, wherein the permanently mechanically deforming includes crimping.

* * * * *